US005111945A

United States Patent [19]

Hull et al.

[11] Patent Number: 5,111,945

[45] Date of Patent: May 12, 1992

[54] BOOM EXTENSION ALIGNMENT DEVICE

[75] Inventors: William E. Hull; Henry D. Barthalow, both of Greencastle, Pa.

[73] Assignee: Kidde Industries, Inc., Iselin, N.J.

[21] Appl. No.: 759,675

[22] Filed: Sep. 13, 1991

[51] Int. Cl.[5] ..... B66C 23/66

[52] U.S. Cl. ..... 212/168; 212/188; 212/266

[58] Field of Search ..... 212/168, 177, 187, 188, 212/266, 267, 268, 269

[56] References Cited

U.S. PATENT DOCUMENTS 3,785,505 1/1974 Keller ..... 212/177
3,944,082 3/1976 Fritsch ..... 212/268
4,483,447 11/1984 Bernabe ..... 212/177

*Primary Examiner*—Sherman Basinger

*Assistant Examiner*—Thomas J. Brahan

*Attorney, Agent, or Firm*—Brady, O'Boyle & Gates

[57] ABSTRACT

An alignment device on a crane boom having telescopic boom sections and a side stowable boom extension swingable from a stowed position to a working position and connectable to a nose assembly on a boom section by upper and lower clevis connections on each side of the nose assembly. The alignment device includes an abutment assembly mounted on the nose assembly boom section, and another abutment assembly mounted on another boom section. The abutment assemblies engage each other during relative retracting movement of the boom sections and forcibly engage the end of the boom extension to align the apertures of the clevis connection and nose assembly to facilitate the insertion of the pin therein.

8 Claims, 8 Drawing Sheets

BOOM EXTENSION ALIGNMENT DEVICE

BACKGROUND OF THE INVENTION

To extend the reach of crane booms having telescopic boom sections, a side stowable jib or boom extension is provided for connection to the nose assembly of the fly section or next adjacent boom section, as disclosed in U.S. Pat. Nos. 3,785,505, dated Jan. 15, 1974; and 4,483,447, dated Nov. 20, 1984.

When moving the boom extension from the stowed position on the side of the telescopic boom, to the operative position, wherein the boom extension extends outwardly in alignment with the longitudinal axis of the boom, the boom extension is pivotally connected to one side of the nose assembly of the boom section and then swung around and connected to the other side of the nose assembly. The connections are made by a plurality of pins extending through aligned holes provided in the cooperating end portions of the boom extension and nose assembly of the fly section.

Due to manufacturing tolerances misalignment may occur between the pin connection holes making it difficult, if not impossible, to insert at least the last pin To facilitate the insertion of the pin by aligning the cooperating holes, crane operators have lowered the nose portion of the boom section and associated partly connected boom extension, so the outer end of the boom extension engages a support stand or the ground, and using the force of the boom extension against the stand or ground and further lowering the boom, the proper alignment of the holes is achieved for insertion of the connecting pin This procedure may be difficult and/or time consuming.

SUMMARY OF THE INVENTION

In order to provide the required force for aligning the pin connection holes between the boom extension and boom nose assembly on the boom fly section the alignment device of the present invention has been devised, to thereby eliminate the need of employing the ground force employed heretofore by crane operators, whereby the connection of the boom extension to the boom section is facilitated.

The boom extension alignment device of the present invention comprises, essentially, a first abutment assembly slidably mounted on the nose portion of a boom section, and a second abutment assembly mounted on another boom section. The boom sections are movable relative to each other, whereby the first and second abutment assemblies are engageable to thereby force the first abutment assembly against one end of the boom extension, to thereby align the pin connection holes between the boom extension and boom section. By this construction and arrangement the telescope cylinder retract force and relative telescopic movement between the boom sections and the associated abutment assemblies facilitate the alignment of the pin holes.

DESCRIPTION OF THE PREFERRED EMBODIMENT

Figure 1:
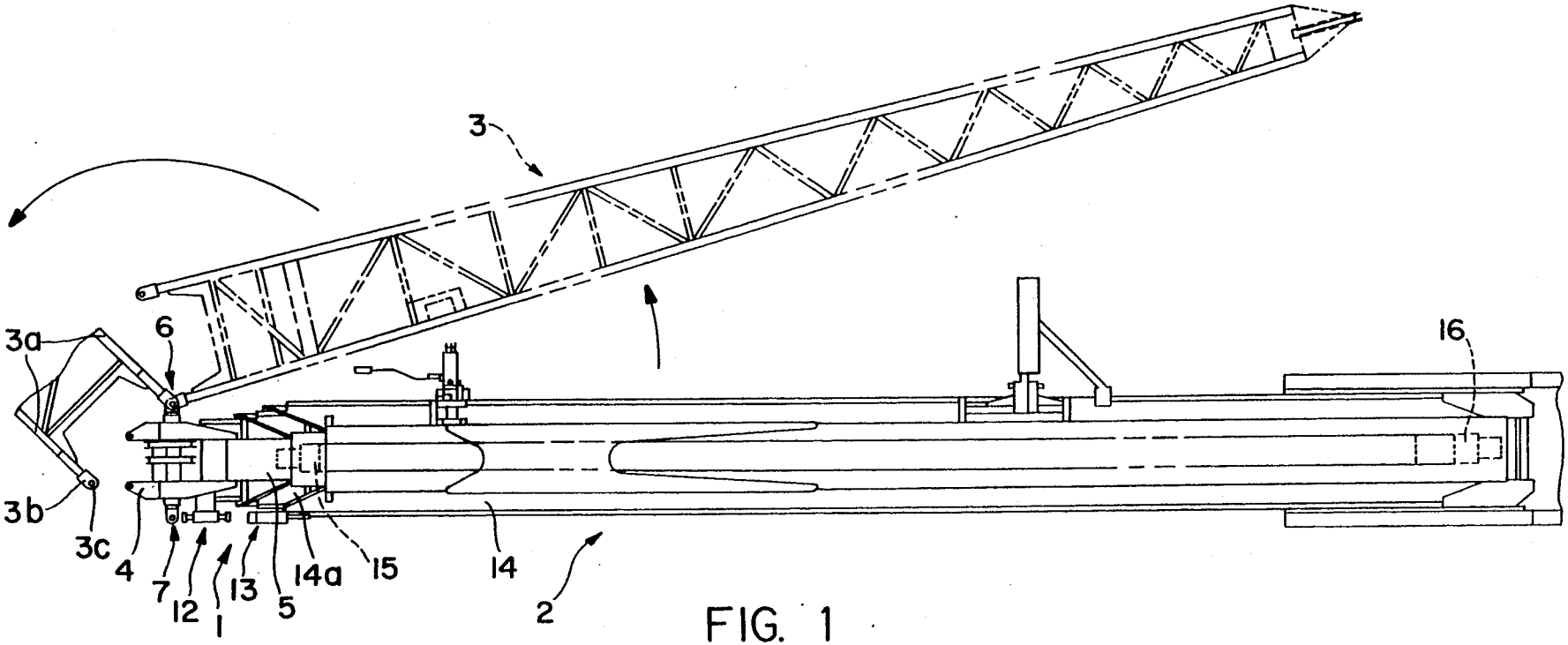
FIG. 1 is a top plan view of a telescopic crane boom having a side stowable jib or boom extension, movable from the stowed position to an operative position on the nose portion of a boom section.

Referring to the drawings, and more particularly to FIG. 1, the alignment device 1 of the present invention is adapted for use on a multi-section telescopic crane boom 2 having a side stowable jib or boom extension 3 movable to an operative position for connection to the nose assembly 4 of a boom section 5, wherein the boom extension 3 is pivotally connected to one side of the nose assembly 4, as at 6, and then swung around and connected to the other side of the nose assembly, as at 7.

Figure 2:
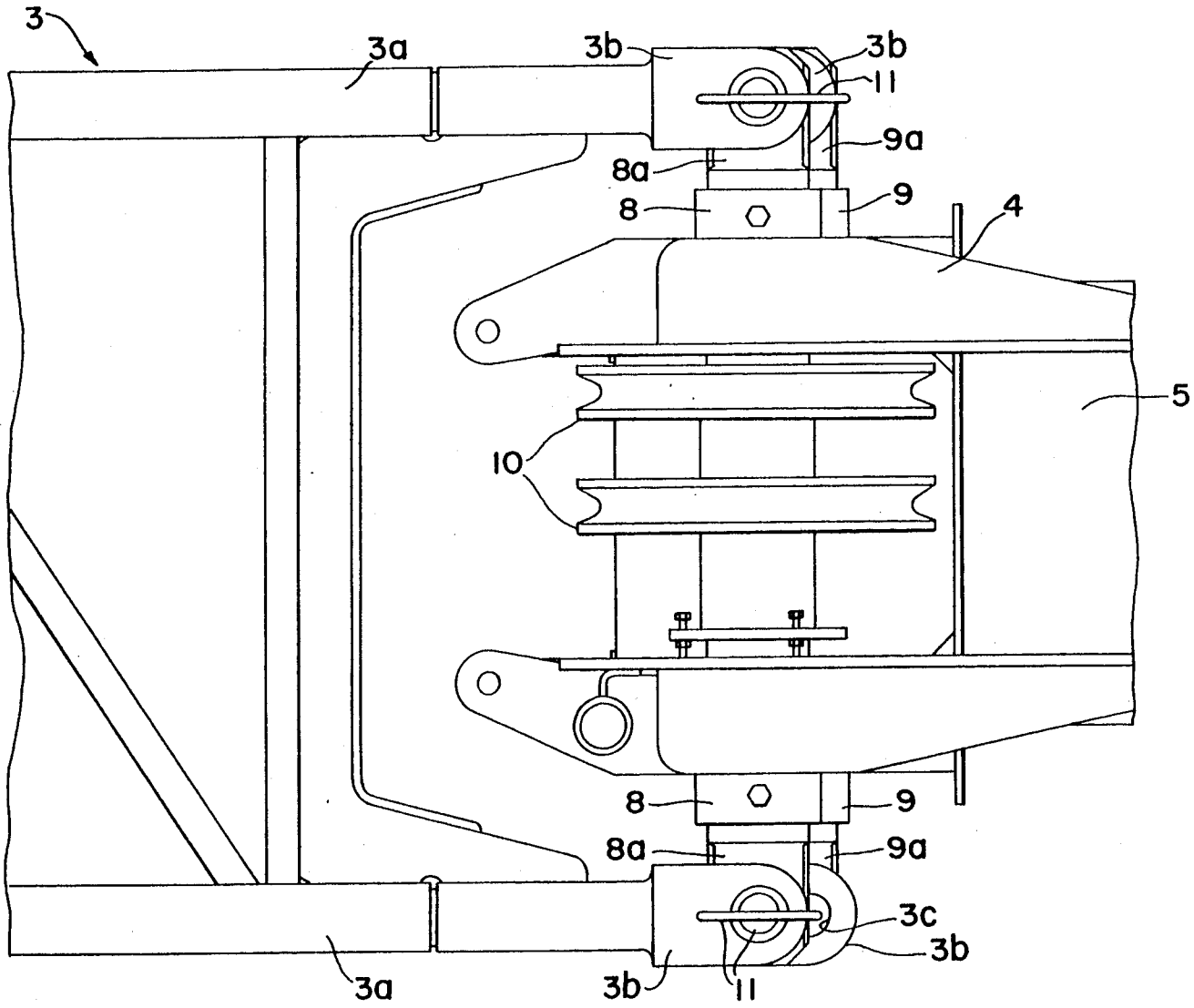
FIG. 2 is an enlarged fragmentary top plan view showing the boom extension partly connected to the nose assembly of the boom section.
Figure 3:
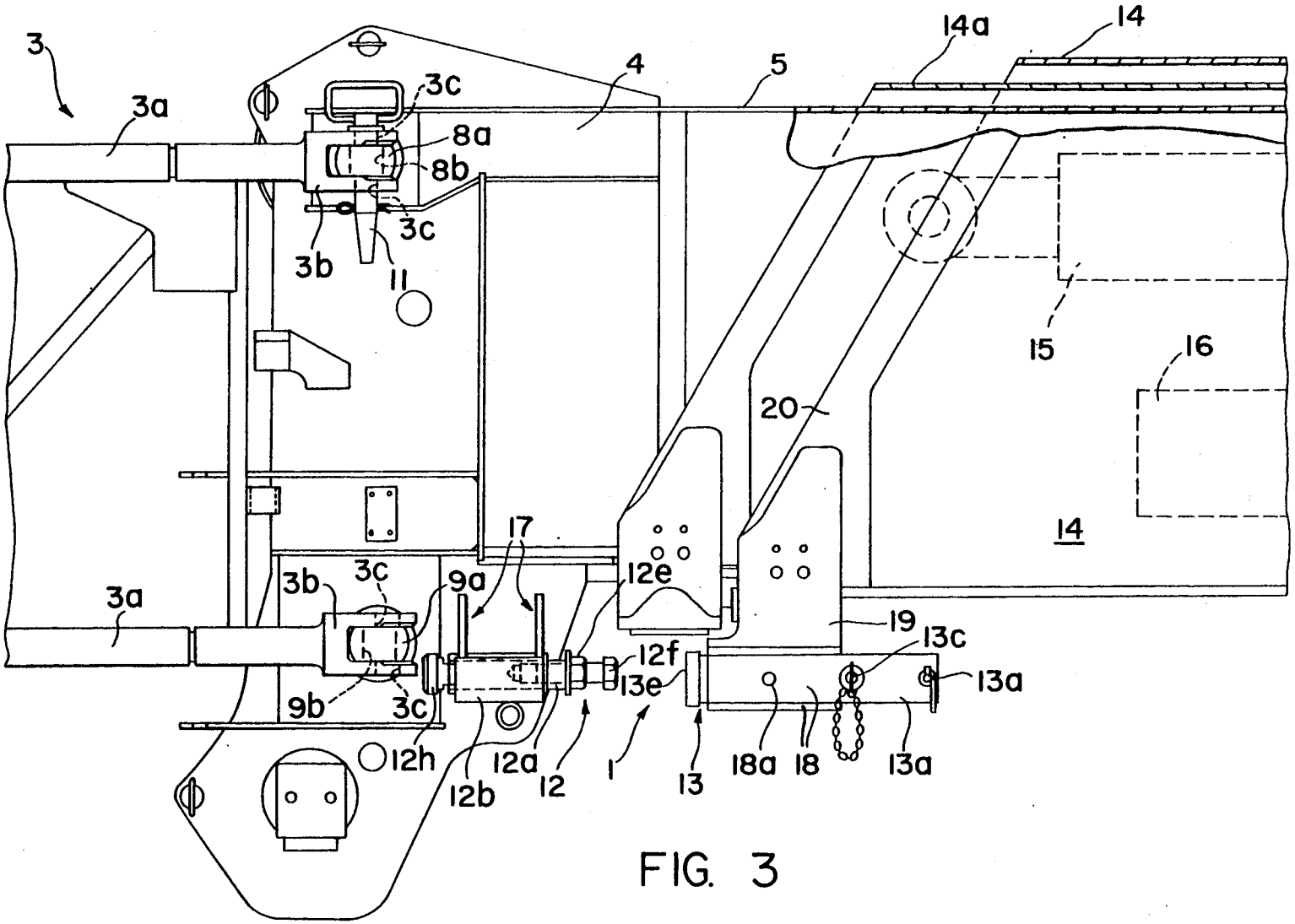
FIG. 3 is a fragmentary, side elevational view showing the boom extension partly connected to the nose assembly of a boom section, and the alignment device of the present invention having one abutment assembly mounted in the nose portion and another abutment assembly mounted on another boom section.

The details of the connections 6 and 7 are illustrated in FIGS. 2 and 3, wherein the nose assembly 4 includes the conventional, vertically spaced horizontal shafts 8 and 9 to which cable sheaves 10 are attached. The opposite ends of the nose assembly shafts 8 and 9 are flattened, as at a 8*a* and 9*a* and provided with apertures or holes 8*b*, 9*b*. The jib 3 or boom extension is of the truss type including four corner struts 3*a*, each terminating in a bifurcated arm 3*b* having holes 3*c* alignable with the nose assembly shaft holes 8*b* and 9*b* through which a pin 11 is insertable, to thereby provide a clevis connection between the boom extension 3 and nose assembly 4.

When moving the boom extension 3 from the stowed position, as shown in FIG. 1, it has been experienced that the upper and lower clevis connections at 6 can be made easily in order to pivotally connect the boom extension to the nose assembly 4 for swinging the boom extension 3 around for connection to the nose assembly as at 7. It has been further experienced that the upper clevis connection, at 7, can also be readily accomplished to partly connect the boom extension 3 to the nose assembly 4; however, due to manufacturing tolerances and the weight of the boom extension, the lower clevis connection at 7 may not be able to be made because the holes 3*c* in the bifurcated arm 3*b* may not be fully aligned with the holes 9*b* in the nose assembly shaft portion 9*a*.

In order to align the holes 3*c* and 9*b* for reception of the pin 11 in the lower clevis connection, the alignment device 1 of the present invention has been devised and, as shown in FIG. 3, comprises a first abutment assembly 12 slidably mounted on the nose portion 4 of the boom section 5, and a second abutment assembly 13 mounted on another boom section 14 of the multi-section crane boom 2, it being understood by those skilled in the art that the nose assembly boom section 5 and boom section 14 and other boom sections in the multi-section crane boom are movable relative to each other in telescopic fashion by hydraulic cylinders 15 and 16. For purposes of illustration the alignment device is shown on a three section boom with hydraulic extension cylinder 16 connected between base section 14 and mid-section 14*a*, and hydraulic extension cylinder 15 connected to extend fly section 5 from midsection 14*a*. The device is also operable on a two section telescopic boom, in a boom having more than three sections, as well as on booms in which the telescopic sections extend equally or proportionally and simultaneously from the base section by an arrangement of cables, or the like, in combination with a hydraulic extension cylinder, all of which are well known in the art.

Figure 6:
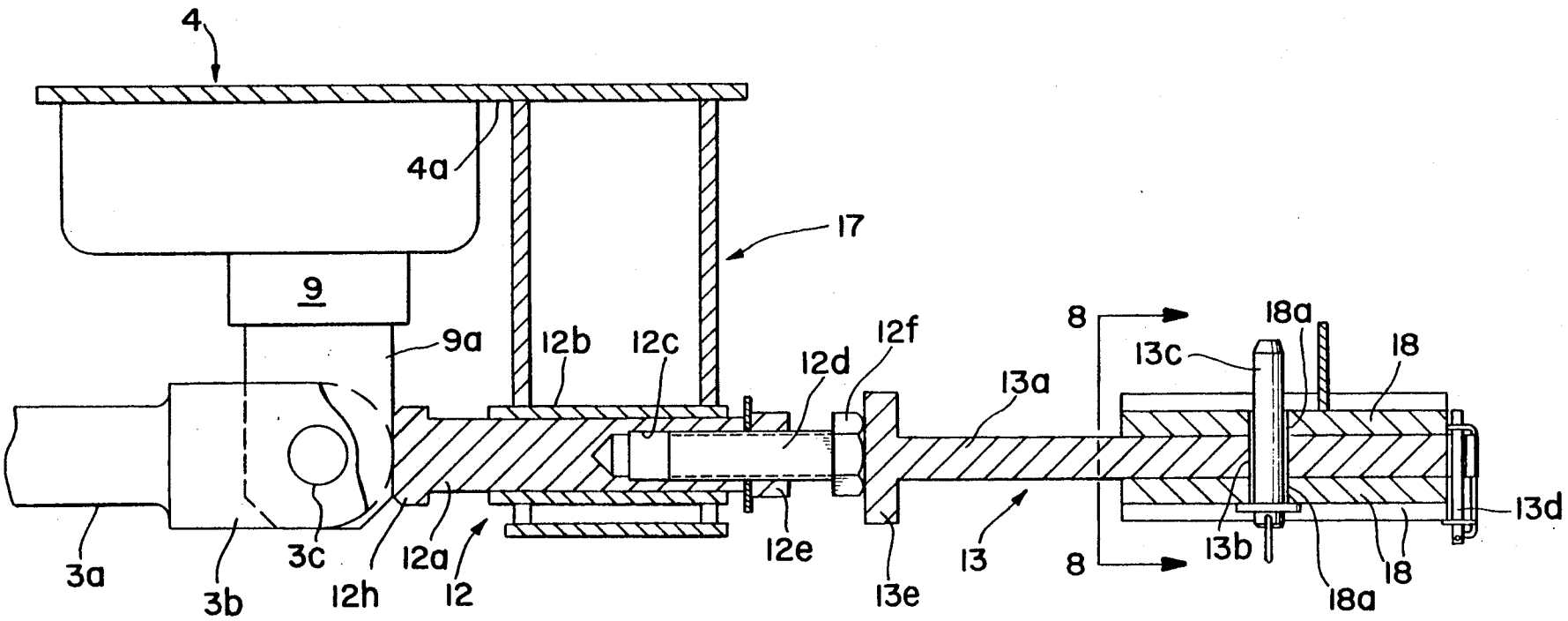
FIG. 6 is a view on an enlarged scale, taken substantially along line 6—6 of FIG. 5.
Figure 7:
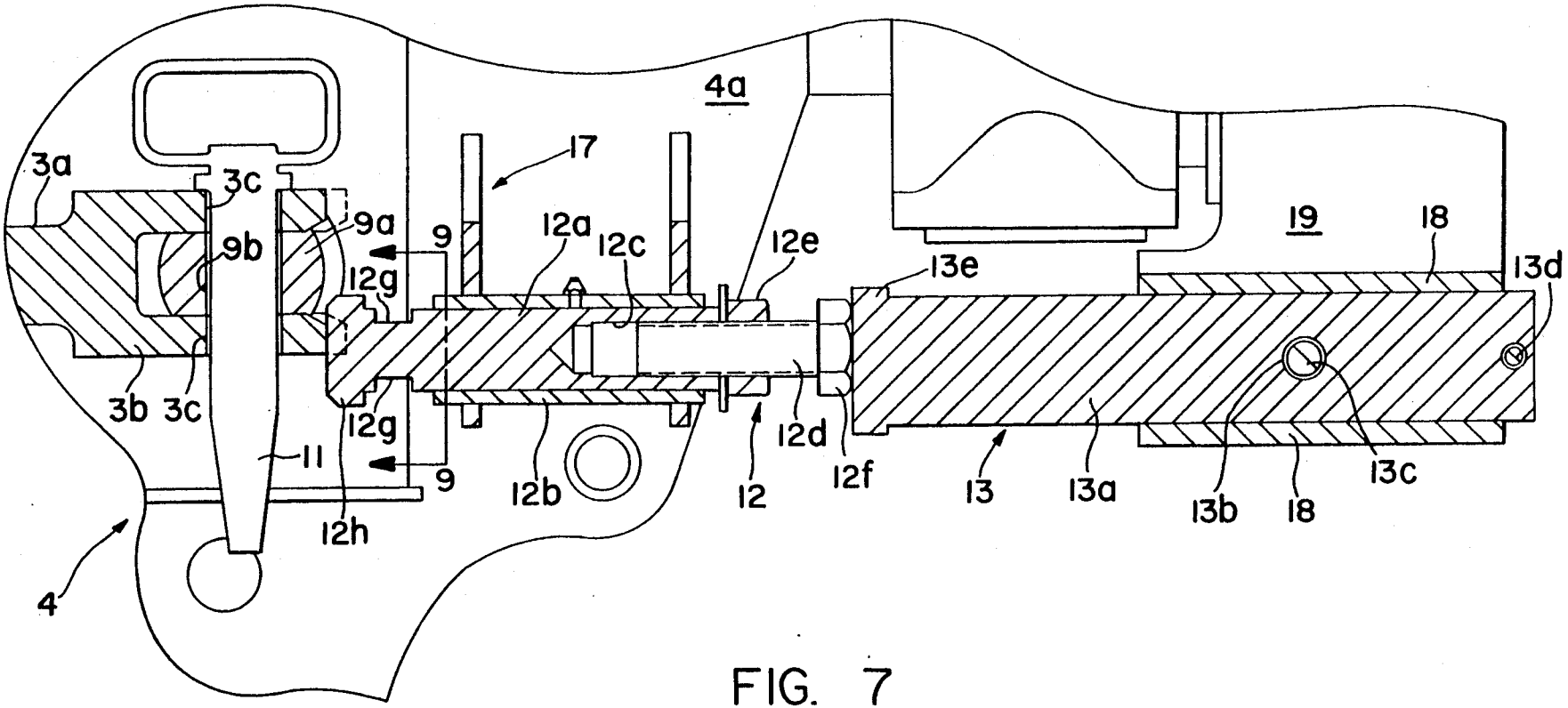
FIG. 7 is a fragmentary, sectional side elevational view, on an enlarged scale, of the alignment device as shown in FIG. 5.

The details of the construction of the abutment assemblies 12 and 13 are illustrated in FIGS. 6 and 7, wherein it will be seen that abutment assembly 12 comprises a rod 12*a* slidably mounted in a cylindrical housing 12*b* fixedly mounted on the side 4*a* of the nose assembly 4 by a bracket 17 extending outwardly therefrom. The rod 12*a* is provided with a threaded bore 12*c* for receiving a bolt 12*d* having a nut 12*e* threaded thereon. The headed end 12*f* of the bolt 12*d* extends axially from the end of the rod 12*a* and its axial position or length can be adjusted by turning the bolt 12*d* in the bore 12*c* and locking its position therein by turning the nut 12*e* against the retaining washer on the end face of the bore 12*c*. To facilitate the adjustment of the bolt 12*d* and the locking of the bolt in the adjusted position, the opposite end portion of the rod 12*a* is provided with flat portions 12*g*, whereby one tool can be placed on the flat portions 12*g*, to hold the rod fixed with a wrench while other tools such as wrenches are employed for turning the bolt 12*d* and nut 12*e*. The rod 12*a* terminates in an enlarged head portion 12*h* which functions to retain the rod in housing 12*h*, and which is adapted to forcibly engage the bifurcated arm 3*b* of the lower clevis connection, to be described more fully hereinafter.

Figure 8:
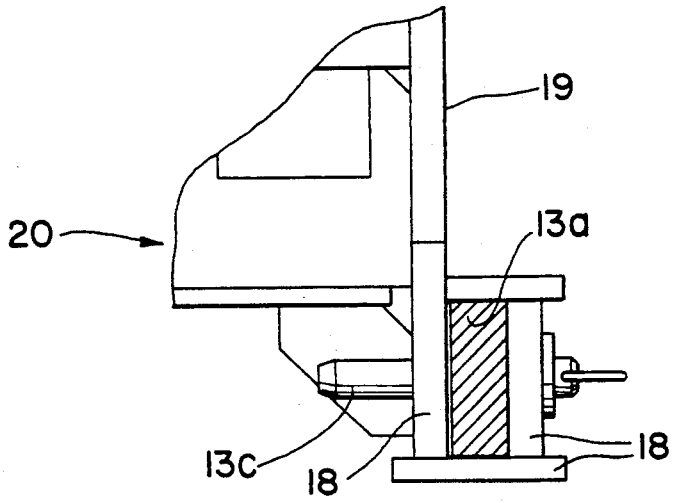
FIG. 8 is a cross-sectional view taken substantially along line 8—8 of FIG. 6.
Figure 9:
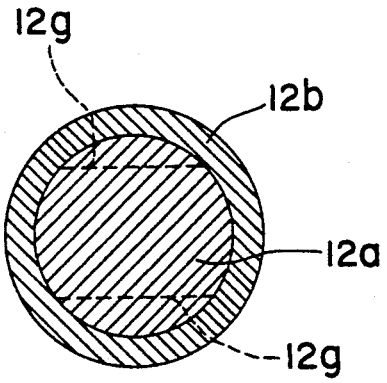
FIG. 9 is an enlarged cross-sectional view taken along line 9—9 of FIG. 7.

The abutment assembly 13 comprises a bar 13*a* slidably mounted in a housing 18 fixedly connected, as shown in FIGS. 3 and 8, to a depending portion 19 of the collar 20 of the boom section 14. The bar 13*a* is provided with an aperture 13*b* alignable with apertures 18*a* provided in the side walls of the housing 18 for receiving a removable pin 13*c*, whereby the position of the bar 13*a* within the housing 18 can be varied from a retracted position, as shown in FIGS. 1, 3, to an extended position, as shown in FIGS. 4, 5, 6 and 7. The end of the bar 13*a* is provided with a stop pin 13*d* engageable with the end face of the housing 18, the opposite end of the bar 13*a* having an enlarged head portion 13*e* which is engageable with the bolt head 12*f* of the abutment assembly 12.

Figure 4:
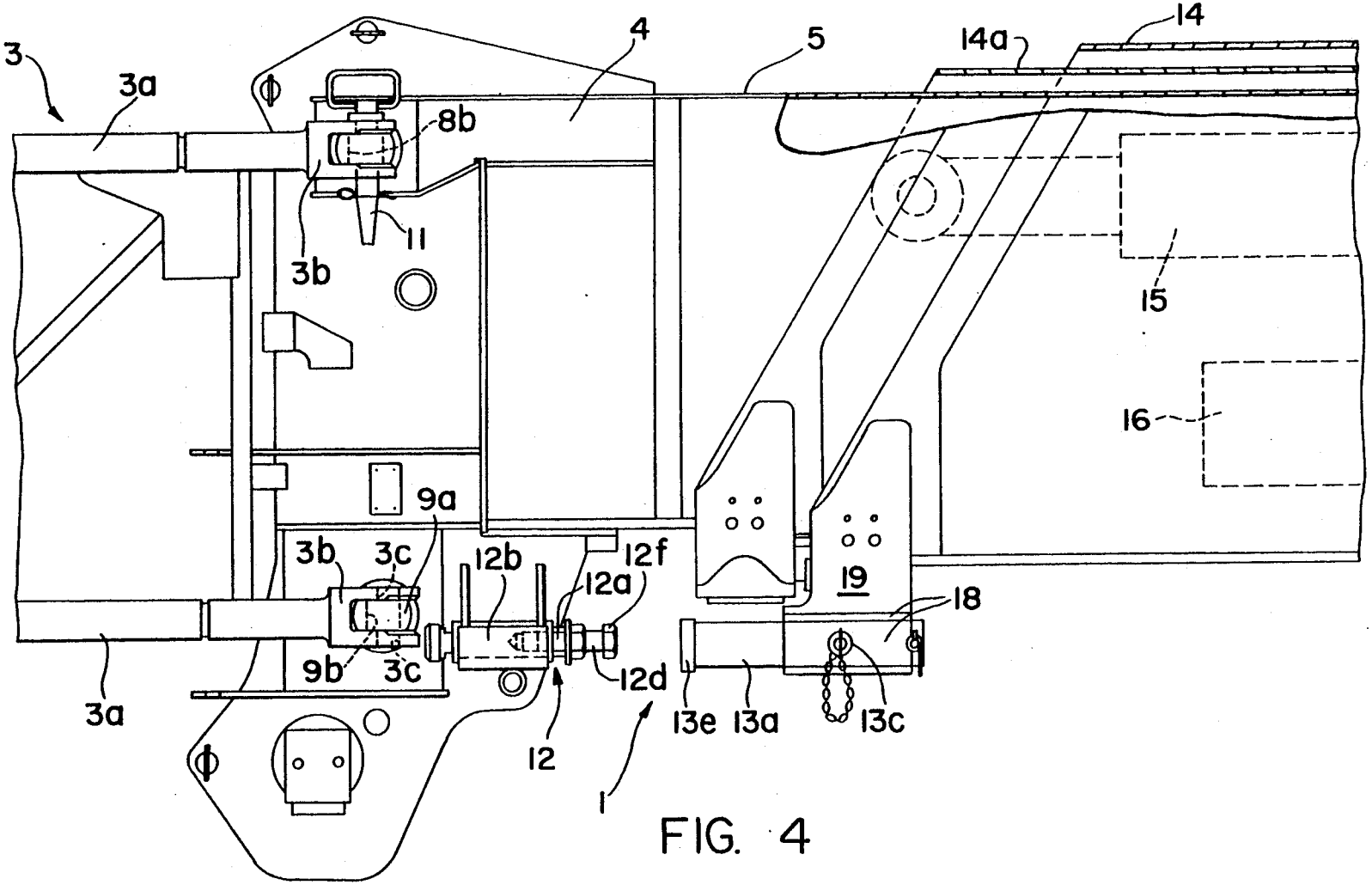
FIGS. 4 and 5 are views similar to FIG. 3 showing the operation of the abutment assemblies to align the pin connection holes for reception of the pin.
Figure 5:
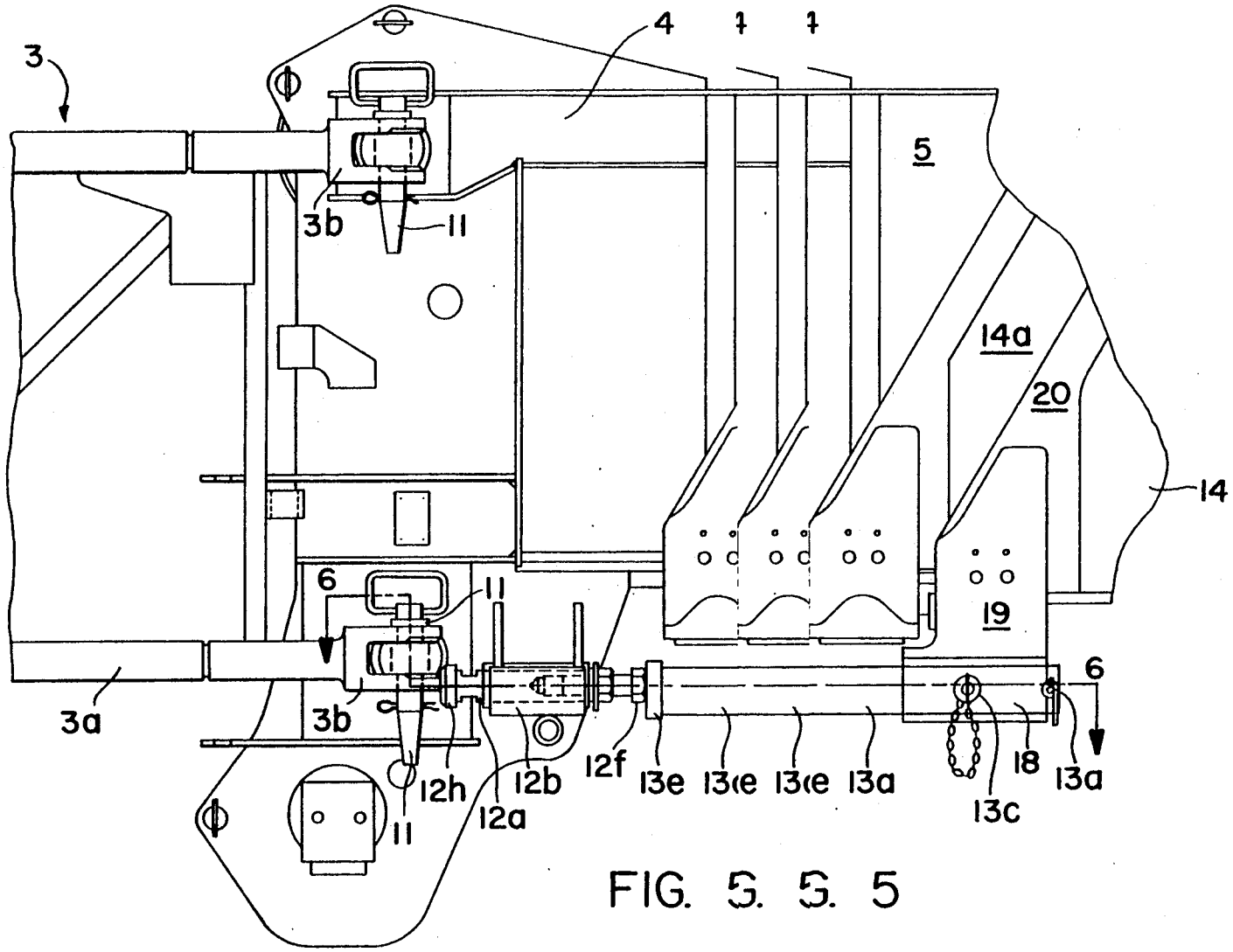

In the operation of the alignment device of the present invention, after the upper and lower clevis connections are made at 6, FIG. 1, the boom extension 3 is swung around to its outwardly extending working position and the upper clevis connection is made at 7, while the apertures 3*c* and 9*b* at the lower connection remain misaligned, as shown in FIGS. 2 and 3. The boom nose assembly is then slightly extended, as shown in FIG. 4, by extending at least the boom section 5 by means of the boom extension means such as the hydraulic cylinder 15. The bar 13*a* is then moved from its retracted position, as shown in FIG. 3, to its extended position, as shown in FIG. 4, by first removing the pin 13*c* from the bar, sliding the bar 13*a* forwardly to align the bar aperture 13*b* with the housing apertures 18*a* and then inserting the pin 13*c* through the aligned apertures 13*b* and 18*a* to thereby fixedly secure the bar 13 in the housing 18. The boom section 5 carrying the nose assembly is then slowly retracted, such as by retracting hydraulic cylinder 15, resulting in the bolt head 12*f* engaging the head portion 13*e* of the bar 13*a*, as shown in FIG. 5. As the boom continues to retract, the head 12*h* of the rod 12*a* engages the lower leg of the bifurcated arms 3*b* as shown in FIG. 7 resulting in the bifurcated arm 3*b* being pushed from the dotted line position forwardly to the solid line position, whereupon the holes 3*c* and 9*b* become aligned for reception of the pin 11. With lower pin 11 in place, the boom section 5 is then extended to remove the bolt head 12*f* and bar head 13*e* from abutting relationship. The pin 13*c* is removed from the aligned apertures in the bar and housing and the bar 13*a* is moved to the retracted position as shown in FIG. 3, and secure in place by reinserting pin 13*c* through aperture 13*b* rearwardly of housing 18.

Due to the possible misalignment of the holes 3*c* and 9*b* in the lower left hand clevis connection, there may be a continued slight misalignment even after the pin 11 has been inserted, resulting in a binding of the pin 11 within the holes; therefore, when the boom extension 3 is to be pivoted to the stowed position, the abutment assemblies 12 and 13 will be manipulated as described hereinabove to once again align the holes 3*c* and 9*b* to facilitate the removal of the pin 11 therefrom.

In brief, to stow the boom extension 3, the boom nose assembly 4 and fly section 5 are extended slightly. Pin 13*c* removed from bar 13*a* which is then slid to its forward most position, and is secured in place by inserting pin 13*c* through aligned apertures 18*a* and 13*b* in the housing 18 and bar 13*a*, respectively. Boom section 5 is then fully retracted, and as 3*b* contacts 12*h* and 12*f* contacts 13*e* to relieve binding of the lower left hand pin 11, that pin is removed. Boom section 5 is then again extended slightly. Pin 13*c* is removed, bar 13*a* is slid to its rear most position, and secured in the retracted position on FIG. 3 by reinserting pin 13*c*. The boom is then fully retracted. The upper left hand pin 11 is removed and the boom extension is swung around, as shown in FIG. 1, toward the stowed position on the side of the boom, and the normal stowage procedures are followed.

From the above description it will be readily apparent to those skilled in the art that the alignment device of the present invention can be retrofitted on existing crane booms and is constructed and arranged to facilitate the connection of a boom extension to a nose assembly in a manner more quickly accomplished than heretofore, by use of the retract force of the boom telescoping cylinder.

The terms and expression which have been employed herein are used as terms of description and not of limitation, and there is no intention, in the sue of such terms and expressions, of excluding any equivalents of the features shown and described or portions thereof, but it is recognized that various modifications are possible within the scope of the invention claimed.

We claim:

1. In a crane boom having relatively movable telescopic boom sections and a side stowable boom extension swingable from a stowed position to a working position and connectable to a nose assembly or a boom section by upper and lower clevis connections on each side of the nose assembly, each clevis connection including an apertured bifurcated arm on the boom extension insertable on an apertured nose assembly shaft portion, the improvement comprising an alignment device operatively connected between the nose assembly boom section and another boom section, whereby upon relative telescopic movement between the nose assembly boom section and said another boom section a bifurcated arm on the boom extension is engaged by the alignment device to align the apertures therein with the apertures in the nose assembly shaft portion to facilitate the insertion of a pin through the aligned apertures.

2. In a crane boom according to claim 1, wherein the alignment device comprises a first abutment assembly mounted on the nose assembly boom section and a second abutment assembly mounted on said another boom section of the crane boom, said abutment assemblies engaging each other during the alignment of said apertures.

3. In a crane boom according to claim 2, wherein the first abutment assembly comprises a housing fixedly mounted on one side of the nose assembly, a rod slidably mounted in said housing, said rod having one end portion extending outwardly from said housing engageable by the second abutment assembly, the other end portion of said rod extending outwardly from the housing and engageable with the bifurcated arm on the boom extension.

4. In a crane boom according to claim 3, wherein said one end portion of the rod comprises a threaded bore provided in said rod, a bolt threadably mounted in said bore and extending axially therefrom, a head provided on said bolt, and a nut threadably mounted on said bolt between the head and an end face of the housing, whereby the position of the bolt in the rod can be adjusted.

5. In a crane boom as set forth in claim 3, including a head portion on said other end portion of said rod.

6. In a crane boom according to claim 2, wherein the second abutment assembly comprises a housing fixedly mounted on said another boom section, a bar slidably mounted in said housing, alignable apertures provided in the side walls of said housing and said bar, a pin insertable through said apertures for fixedly mounting said bar in said housing, said bar having an end portion extending axially outwardly from said housing, and said end portion adapted to engage said first abutment assembly

7. In a crane boom as set forth in claim 6, including an enlarged head portion on said end portion of said bar extending outwardly of said housing.

8. In a crane boom having relatively movable telescopic boom sections and a side stowable boom extension swingable from a stowed position to a working position and connectable to a nose assembly or a boom section by upper and lower clevis connections on each side of the nose assembly, each clevis connection including an apertured bifurcated arm on the boom extension insertable on an apertured nose assembly shaft portion, the improvement comprising an alignment device operatively connected between the nose assembly boom section and another boom section, whereby upon relative telescopic movement between the nose assembly boom section and said another boom section the boom extension is engaged by the alignment device to align the apertures therein with the apertures in the nose assembly shaft portion to facilitate the insertion of a pin through the aligned apertures.

* * * * *